US007459622B2

(12) United States Patent
Hsieh

(10) Patent No.: US 7,459,622 B2
(45) Date of Patent: Dec. 2, 2008

(54) PORTABLE TRUMPET STAND

(75) Inventor: Wu-Hong Hsieh, Lu Chou (TW)

(73) Assignee: K.H.S. Musical Instrument Co., Ltd., Taipei Hsien (TW)

( * ) Notice: Subject to any disclaimer, the term of this patent is extended or adjusted under 35 U.S.C. 154(b) by 0 days.

(21) Appl. No.: 11/655,716

(22) Filed: Jan. 19, 2007

(65) Prior Publication Data

US 2008/0173154 A1 Jul. 24, 2008

(51) Int. Cl.
*G10D 7/10* (2006.01)

(52) U.S. Cl. ..... 84/387 A; 248/176.1

(58) Field of Classification Search ..... 84/387 A, 84/385 A, 421, 453; 248/176.1, 443, 460
See application file for complete search history.

(56) References Cited

U.S. PATENT DOCUMENTS 4,145,950 A * 3/1979 Glantz ..... 84/385 R
4,407,182 A * 10/1983 Biasini ..... 84/453
6,316,706 B1 * 11/2001 Sammons ..... 84/327
2003/0007360 A1 * 1/2003 Hsieh ..... 362/411

* cited by examiner

*Primary Examiner*—Walter Benson
*Assistant Examiner*—Jianchun Qin
(74) *Attorney, Agent, or Firm*—William E. Pelton, Esq.; Cooper & Dunham LLP

(57) ABSTRACT

A portable trumpet stand has an instrument bracket, multiple legs and a central post. The instrument bracket has a central hole, a top and a bottom. The legs are mounted pivotally around and protrude out radially from the instrument bracket, and each leg has a proximal end pivotally mounted in the instrument bracket. The central post is mounted slidably in the central hole of the instrument bracket, has a top end, a bottom end and a spherical cushion. The bottom end can be secured in the central hole so the central post protrudes perpendicularly up to be mounted in a cylindrical metal tube of a trumpet to hold the trumpet in position. The portable trumpet stand can be collapsed and stored in the cylindrical metal tube of a trumpet so the portable trumpet stand and the trumpet can be stored in a case altogether.

6 Claims, 7 Drawing Sheets

PORTABLE TRUMPET STAND

BACKGROUND OF THE INVENTION

1. Field of the Invention

The present invention relates to a stand, and more particularly to a portable trumpet stand that is convenient to carry.

2. Description of Related Art

The trumpet is a musical wind instrument, has a cylindrical metal tube expanding into a bell wire and is usually equipped with multiple valve bottoms that change the instrument's pitch.

Trumpet stands temporarily hold trumpets and keep the trumpets from collapsing. With reference to FIG. 7, a conventional trumpet stand has a base (50), multiple legs (52) and a post (51). The legs (52) are attached to and protrude radially from the base (50) so the trumpet stand stands stably on virtually any planar surface. Each leg (52) has a proximal end. The proximal ends are attached pivotally to the base (50), such that the legs (52) can fold down. The post (51) is mounted securely in the base (50), is stationary relative to the base (50) and has a top end, a retainer (510), a resilient element (511) and an instrument bracket (512). The retainer (510) is mounted slidably on the post (51) and has a threaded pin (513). The threaded pin (513) is screwed through the retainer (510) and presses against the post (51) to hold the retainer (510) in position. The resilient element (511) is mounted around the post (51) and has a top end and a bottom end. The top end is mounted through a bell and in a cylindrical metal tube of a trumpet. The bottom end abuts the retainer (510). The instrument bracket (512) is hemispheric, is mounted slidably on the post (51) and in the cylindrical metal tube of a trumpet, holds the trumpet in position on the trumpet stand and has a bottom. The bottom abuts the top end of the resilient element (511).

Although the conventional trumpet stand adequately holds the trumpet, the conventional trumpet stand is inconvenient to carry even if it is folded. Musicians have to carry the trumpet in a trumpet case in one hand and the conventional trumpet stand in the other hand. In this manner, trombonists become tired and have trouble moving around.

To overcome the shortcomings, the present invention provides a portable trumpet stand to obviate or mitigate the aforementioned problems.

SUMMARY OF THE INVENTION

The main objective of the present invention is to provide a portable trumpet stand that is foldable and is convenient to carry.

To achieve the objective, the portable trumpet stand in accordance with the present invention comprises an instrument bracket, multiple legs and a central post.

The instrument bracket has a central hole, a top and a bottom and is mounted in a bell of a cylindrical metal tube of a trumpet either from the top or the bottom.

The legs are mounted pivotally around and protrude out radially and slightly down from the instrument bracket so the instrument bracket can stand stably on a planar surface or be folded down and stored in a bell and cylindrical metal tube of a trumpet. Each leg has a proximal end. The proximal ends are mounted pivotally in the instrument bracket, such that the legs can be folded down and stored in the cylindrical tube of a trumpet.

The central post is mounted slidably through the central hole of the instrument bracket and has a top end, a bottom end and a spherical cushion. The bottom end detachably mounted in the central hole of the instrument bracket so the central post protrudes perpendicularly up from the instrument bracket to be mounted in the cylindrical metal tube of a trumpet. The spherical cushion is mounted on the top end and is mounted in and holds the cylindrical metal tube to hold the trumpet in position. To store the portable trumpet stand, the central post is disengaged from the central hole and slides down and protrudes through the instrument bracket until the spherical cushion abuts the top of the instrument bracket.

Consequently, the portable trumpet stand can be inserted into and carried in the bell of the cylindrical metal tube of the trumpet, and the portable trumpet stand and the trumpet can be carried in a trumpet case altogether. In this manner, a musician can conveniently carry the case.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
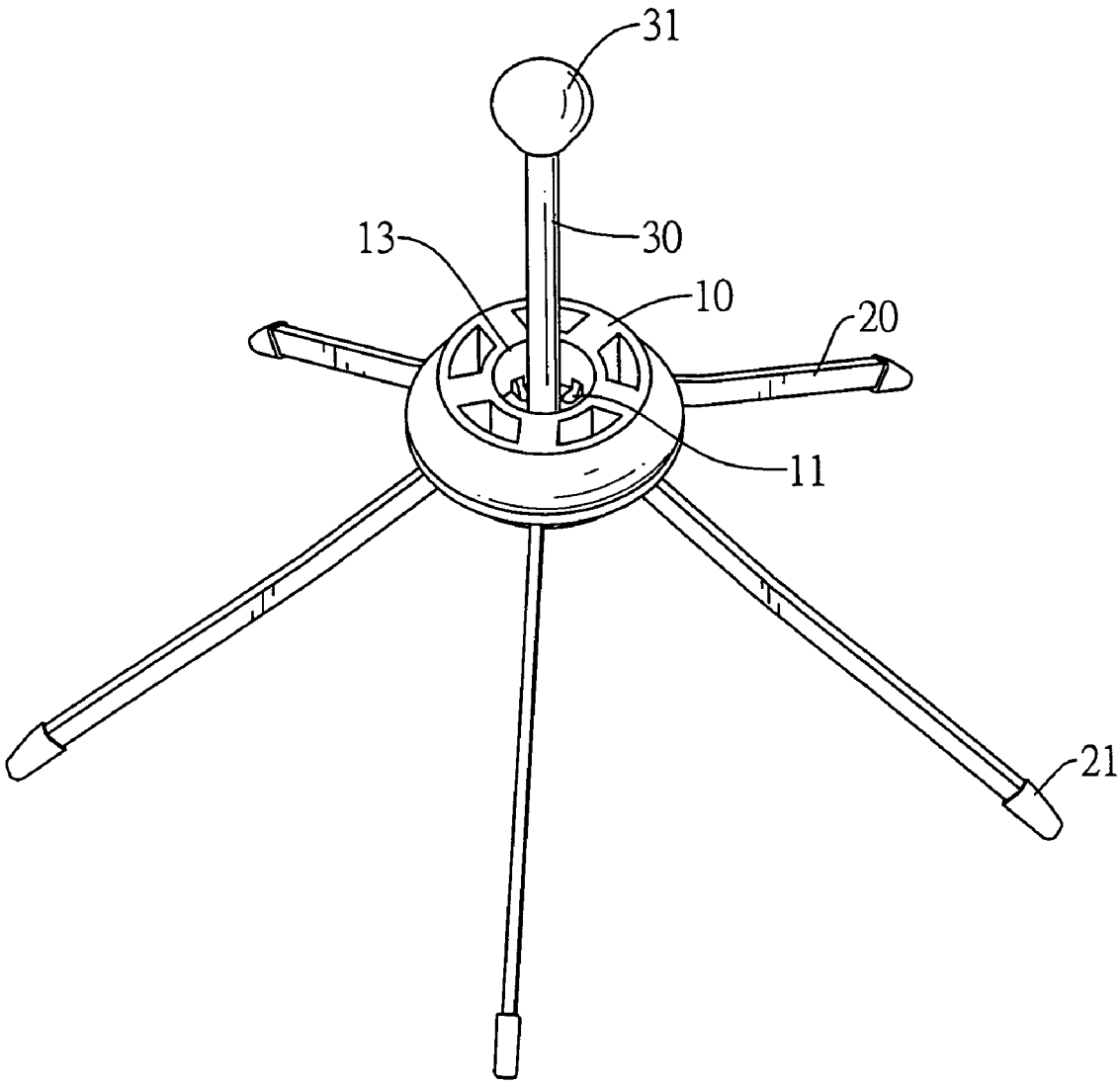
FIG. 1 is a perspective view of a portable trumpet stand in accordance with the present invention.
Figure 2:
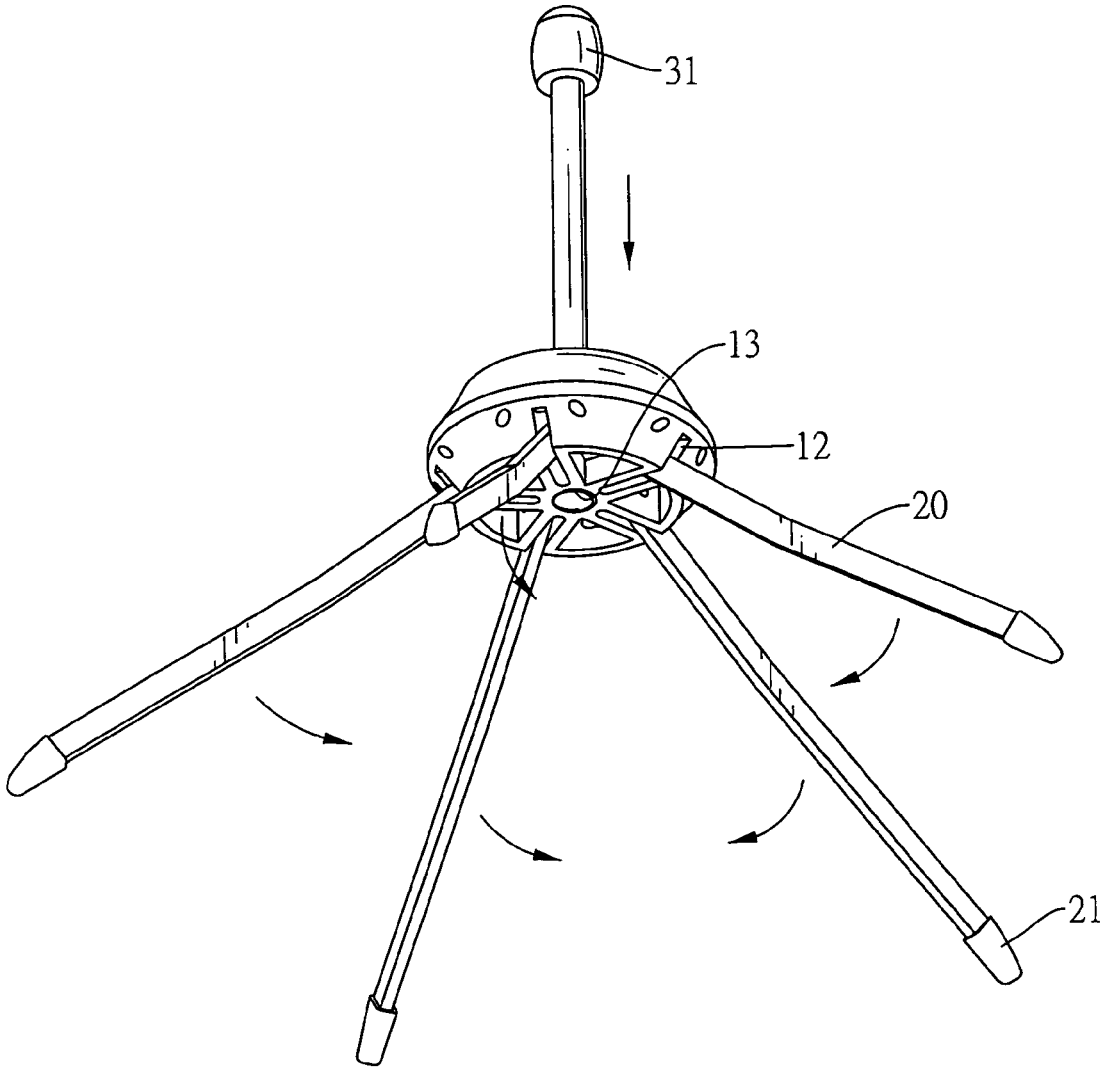
FIG. 2 is an operational perspective view of the portable trumpet stand in FIG. 1 being folded for storage.
Figure 3:
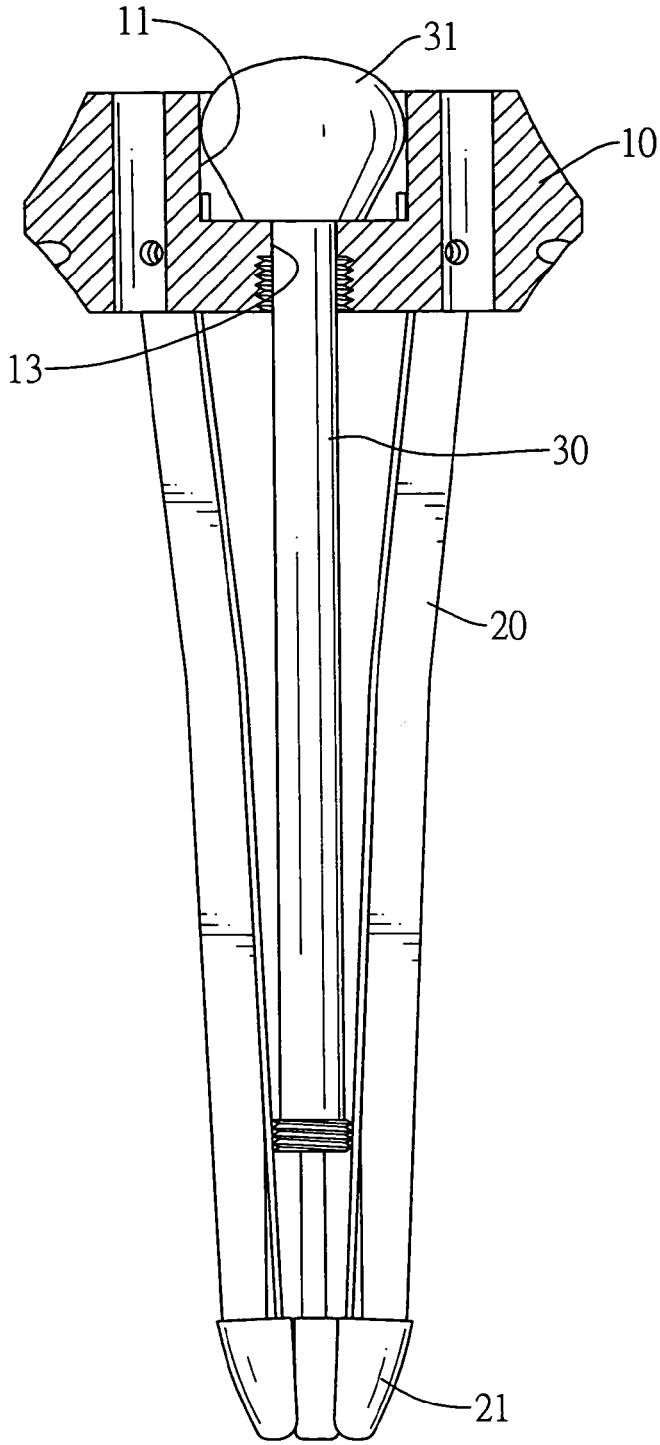
FIG. 3 is a side view in partial section of the portable trumpet stand in FIG. 1 folded.

With reference to FIGS. 1, 2 and 3, the portable trumpet stand in accordance with the present invention comprises an instrument bracket (10), multiple legs (20) and a central post (30).

Figure 6:
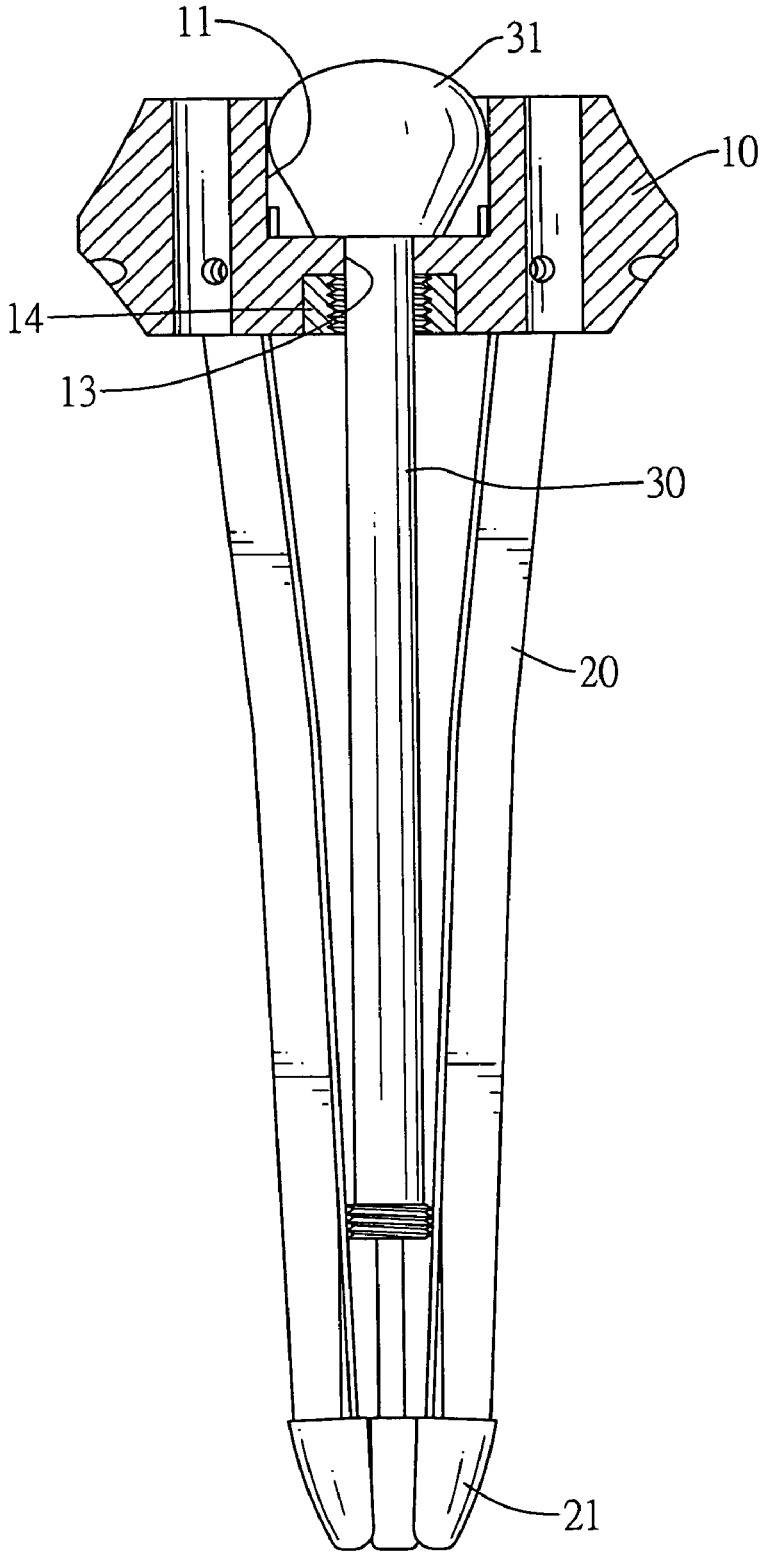
FIG. 6 is a side view in partial section of another embodiment of the portable trumpet stand in accordance with the present invention folded.
Figure 7:
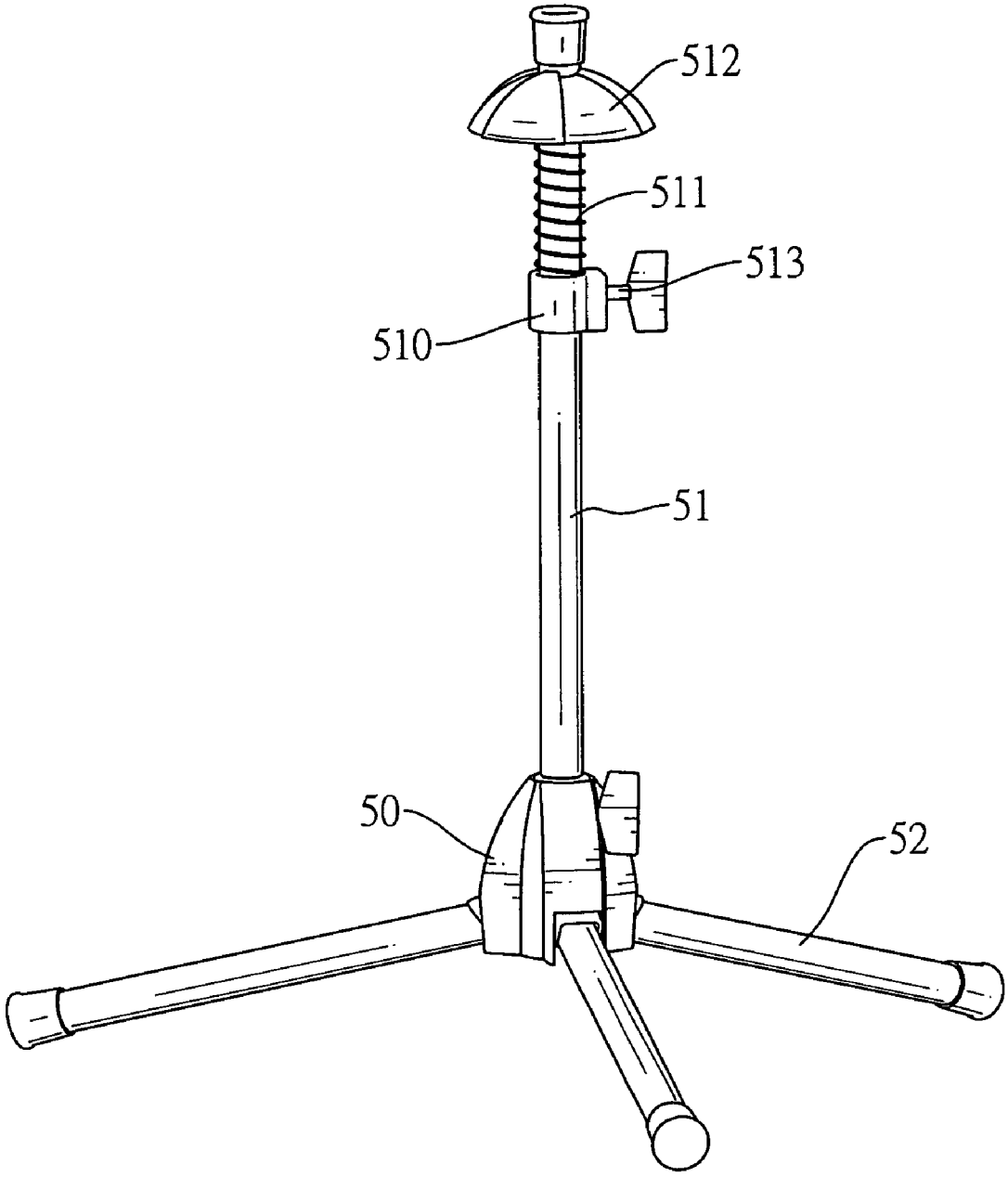
FIG.7 PRIOR ART
FIG. 7 is a perspective view of a conventional portable trumpet stand in accordance with the prior art.

With further reference to FIG. 6, the instrument bracket (10) is a truncated cone and has a top surface, a bottom edge, a central recess (11), a central hole (13) and multiple slots (12). The central recess (11) is formed in the top surface of the instrument bracket (10). The central hole (13) is formed in the central recess (11) through the instrument bracket (10), communicates with the central hole (13) and has a bottom and a threaded inner surface. The threaded inner surface is formed at the bottom of the central hole (13) and may be a threaded plug (14). The threaded plug (14) may be a nut, is mounted in the bottom of the central hole (13) and has a threaded hole. The slots (12) are formed radially around the bottom edge of the instrument bracket (10). Each slot (12) has an upper edge and may have a hinge. The hinges are securely mounted respectively inside the slots (12).

The legs (20) are mounted pivotally respectively in the slots (12), and each leg (20) has a proximal end, a distal end and an end cap (21). The proximal ends are mounted pivotally respectively in the slots (12) and may be connected pivotally respectively to the hinges. The end caps (21) are mounted securely respectively on the distal ends of the legs (20). When the legs (20) are extended, the legs (20) respectively abut the upper edges of the slots (12) to hold the legs (20) at an incline.

Figure 4:
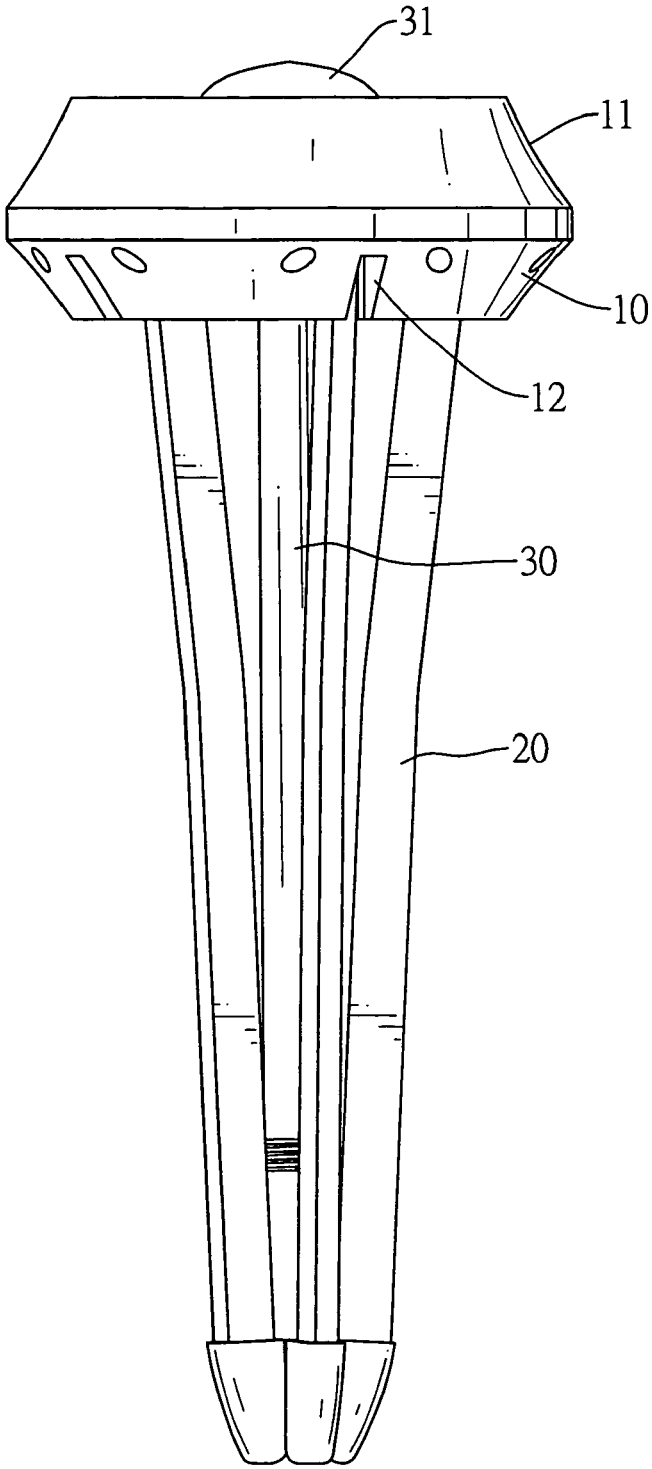
FIG. 4 is a side view of the portable trumpet stand in FIG. 3.
Figure 5:
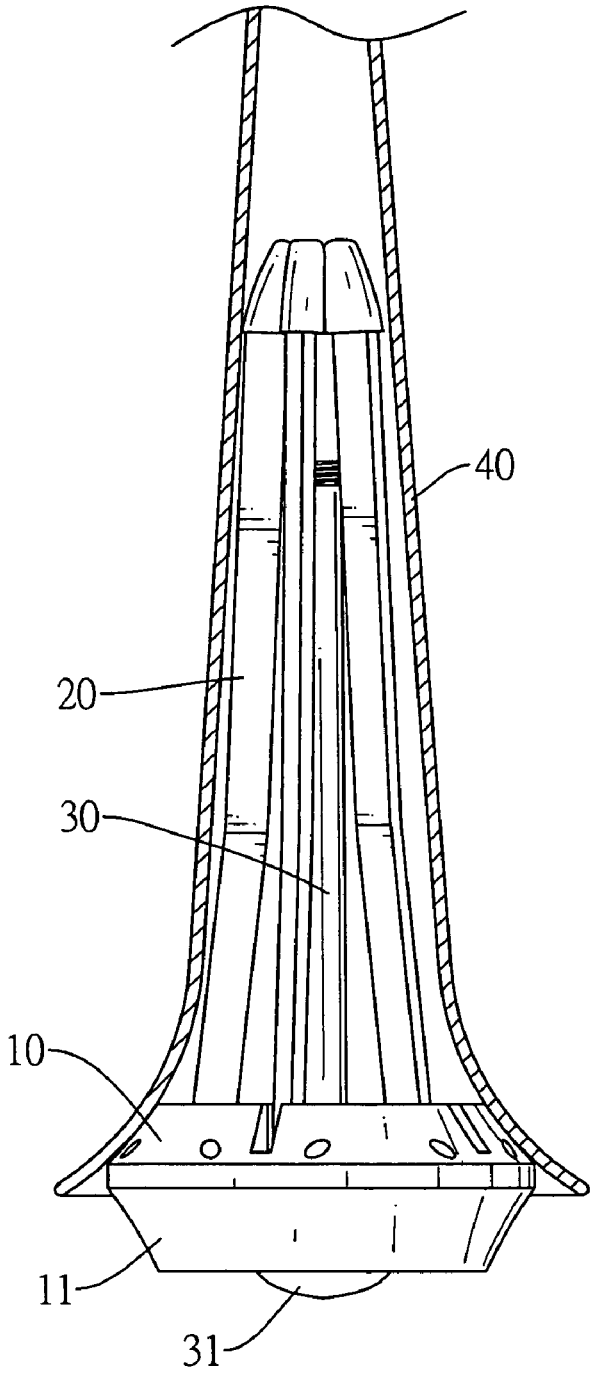
FIG. 5 is a side view in partial section of the folded portable trumpet stand in FIG. 4 stored in a bell of a cylindrical metal tube of a trumpet.

The central post (30) is mounted slidably through the central hole (13) in the instrument bracket (10) and has a top end, a bottom end and a spherical cushion (31). The bottom end has an outer thread that screws into the inner threaded surface in the central hole (13) or the threaded plug (14) to hold the central post (30) in an extended configuration from the top surface of the instrument bracket (10). With further reference to FIG. 4, unscrewing the central post (30) allows the central post (30) to be retracted through the instrument bracket (10) and align with the legs (20) so the legs (20) and the central post (30) can be stored in a cylindrical metal tube (40) of a trumpet. With further reference to FIG. 5, the spherical cushion (31) is mounted securely on the top end, corresponds to and is held in the central recess (11) when the central post (30) is retracted into the instrument bracket (10) and is mounted in a cylindrical metal tube (40) of a trumpet when the central post (30) is extended.

With the central post (30) retracted into the central hole (13) and the legs (20) folded downward against the central post (30), the legs (20) and the central post (30) displace a small volume, have a conical shape that corresponds to a bell of the cylindrical metal tube (40) of a trumpet and can be easily be stored in the bell. Consequently, the portable trumpet stand and the trumpet can be carried in a trumpet case altogether. In this manner, a musician can conveniently carry a trumpet and the portable trumpet stand in the case.

Even though numerous characteristics and advantages of the present invention have been set forth in the foregoing description together with details of the structure and function of the invention, the disclosure is illustrative only. Changes may be made in detail especially in matters of shape, size and arrangement of parts within the principles of the invention to the full extent indicated by the broad general meaning of the terms in which the appended claims are expressed.

What is claimed is:

1. A portable trumpet stand comprising an instrument bracket being a truncated cone and having a top surface;

a bottom edge; and a central hole being formed through the instrument bracket and having a bottom; and a central recess formed in the top surface of the instrument bracket and communicating with the central hole;

multiple legs being mounted pivotally respectively around the bottom edge of the instrument bracket and each leg having a proximal end; and a distal end; and a central post being mounted slidably through the central hole in the instrument bracket and having a top end; a bottom end being detachably mounted in the central hole; and a spherical cushion being mounted securely on the top end of the central post and corresponding to and being held in the central recess when the central post is retracted into the instrument bracket.

2. The portable trumpet stand as claimed in claim 1, wherein the central hole further has a threaded inner surface formed in the bottom of the central hole; and the bottom end of the central post further has an outer threaded surface threaded with the threaded inner surface of the central hole.

3. The portable trumpet stand as claimed in claim 1, wherein the instrument bracket further has a threaded plug mounted in the bottom of the central hole and having a threaded hole.

4. The portable trumpet stand as claimed in claim 3, wherein the threaded plug is a nut.

5. The portable trumpet stand as claimed in claim 1, wherein the instrument bracket further has multiple slots being formed radially around the bottom edge of the instrument bracket, and each slot having an upper edge; and the proximal end of each leg being mounted pivotally in one of the slots and selectively abutting the upper edges of the slot when the leg are rotating.

6. The portable trumpet stand as claimed in claim 1, wherein each leg further has an end cap being mounted securely on the distal end of the leg.

* * * * *